US006883735B2

(12) United States Patent
Ganzer

(10) Patent No.: US 6,883,735 B2
(45) Date of Patent: Apr. 26, 2005

(54) INTEGRAL NOZZLE CLEANING SYSTEM

(75) Inventor: Charles P. Ganzer, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/419,643

(22) Filed: Apr. 21, 2003

(65) Prior Publication Data

US 2004/0217216 A1 Nov. 4, 2004

(51) Int. Cl.[7] ..... B05B 1/04

(52) U.S. Cl. ..... 239/594; 239/106; 239/116; 239/271

(58) Field of Search ..... 239/594, 589, 239/271, 272, 106, 116, 115

(56) References Cited

U.S. PATENT DOCUMENTS 1,342,027 A * 6/1920 Murphy ..... 239/117
1,364,566 A * 1/1921 Logan ..... 222/149
1,529,774 A 3/1925 Delas
2,117,647 A * 5/1938 Boehm ..... 239/117
2,594,045 A * 4/1952 Loepsinger ..... 239/412
2,673,121 A * 3/1954 Brennan ..... 219/629
3,456,871 A 7/1969 Gosling
3,658,257 A * 4/1972 Rood ..... 239/589
4,280,796 A 7/1981 Reinsch
5,033,676 A * 7/1991 King et al. ..... 239/107
5,044,555 A * 9/1991 Youngeberg et al. ..... 239/583
5,119,991 A * 6/1992 Divers ..... 239/106
5,857,838 A 1/1999 Wagner, Jr.
5,887,757 A 3/1999 Jenkins et al.

* cited by examiner

*Primary Examiner*—Theresa Trieu
(74) *Attorney, Agent, or Firm*—Wood, Herron & Evans, L.L.P.

(57) ABSTRACT

A nozzle for a liquid dispenser that incorporates a cleaning probe capable of removing foreign debris from a nozzle discharge passageway. The cleaning probe is moveable between a retracted position that permits fluid flow to a discharge orifice terminating the discharge passageway and an extended position in which the cleaning probe extends into the discharge passageway. As the cleaning fixture advances from the retracted position to the extended position, foreign debris present in the discharge passageway is displaced and ejected out of the discharge orifice.

22 Claims, 2 Drawing Sheets

INTEGRAL NOZZLE CLEANING SYSTEM

FIELD OF THE INVENTION

The present invention generally relates to liquid dispensing apparatus and methods and, more particularly, to nozzles for liquid dispensing modules having a need to be cleaned of debris which may collect and cause clogging.

BACKGROUND OF THE INVENTION

Liquid dispensing systems are incorporated into many manufacturing production lines for dispensing a liquid onto a substrate. Certain liquid dispensing systems are configured for applying a pattern of a heated liquid, such as a thermoplastic material or a hot melt adhesive, to a continuously-moving substrate, such as a woven or non-woven web used in the manufacture of multilayer diapers and other multilayer hygienic products. To that end, liquid dispensing systems include one or more discharge passageways arranged to provide the pattern. Typically, the discharge passageways are located in corresponding nozzles removably attached directly or indirectly to a liquid distribution manifold. The flow of liquid from a liquid supply to the nozzle may be interrupted by a valve element of an intervening dispensing module for dispensing the liquid with a pattern.

Particles may be present in the liquid being dispensed from the discharge passageway. For example, liquids in hot melt adhesive dispensing may include solidified, insoluble particles or char produced by operation of a melter providing the hot melt adhesive to the liquid dispensing system. Relatively small particles pass through the discharge passageway and are dispensed along with the liquid. Relatively large particles may become lodged in the discharge passageway and produce clogs. As a result, the discharge passageway is susceptible to partial or total obstruction by foreign debris that either reduces or prohibits liquid flow to the discharge orifice. Flow restriction may also arise from solidified liquid coating the wall surrounding the discharge passageway. Yet another source of particles is debris originating from solidified liquid residue produced during non-operational intervals, such as maintenance periods. This can adversely affect adhesive bonding and reduce product quality.

Conventionally, clogged discharge passageways in a nozzle are cleaned by halting the flow of product in the production line and removing the clogged nozzle from the liquid dispensing system. The clogged nozzle is disassembled and the discharge passageway is cleaned of debris. The reassembled nozzle is reintroduced into the adhesive dispensing system, adjusted and calibrated. The production line is then restarted. The cleaning process is time consuming and labor intensive. Moreover, because the production line is stopped to clean the nozzle, the process throughput is reduced.

What is needed, therefore, is a liquid dispensing system in which the discharge passageway of a nozzle can be cleared of obstructions without removing the nozzle from the dispensing system.

SUMMARY Of INVENTION

The present invention provides a nozzle that includes a coupling member, and a nozzle body capable of being coupled mechanically by the coupling member with the liquid dispenser. The nozzle body has a discharge passageway adapted to be coupled in fluid communication with a liquid supply passageway of a liquid dispenser. The nozzle further includes a cleaning probe moveable between a retracted position in which liquid flows through the discharge passageway of the nozzle body and an extended position in which the cleaning probe extends into the discharge passageway. When the cleaning probe is moved from the retracted position to the extended position, foreign debris in the discharge passageway is ejected from the discharge orifice.

The present invention also provides a method of operating a thermoplastic material dispenser capable of dispensing thermoplastic material through a discharge passageway in a nozzle. The method includes extending a cleaning probe integral with a nozzle to an extended position within the discharge passageway and retracting the cleaning probe from the extended position to a retracted position withdrawn from the discharge passageway.

According to the principles of the invention, the discharge passageway in a dispenser nozzle may be cleaned frequently, while minimizing idle production time required for performing the cleaning. Frequent cleaning of the discharge passageway at periodic intervals increases the product quality by minimizing the occurrence of clogs. The ability to rapidly clean the discharge passageway without removing the nozzle from the liquid dispenser reduces the down time of the production line, which also increases throughput and decreases cost. The discharge passageway may be cleaned periodically according to a preventative maintenance schedule or upon the observation of a clogged discharge passageway.

Various additional advantages and features of the invention will become more readily apparent to those of ordinary skill in the art upon review of the following detailed description taken in conjunction with the accompanying drawings.

DETAILED DESCRIPTION

Figure 1:
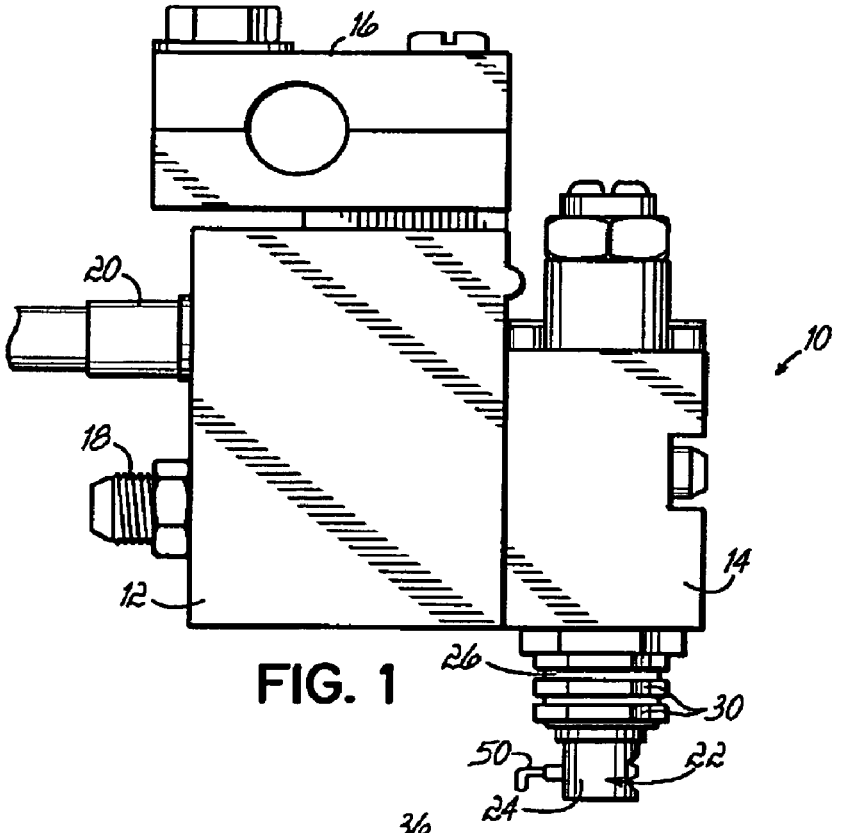
FIG. 1 is a side elevational view of a liquid dispensing module and a nozzle attached to the liquid dispensing module.

With reference to FIG. 1, a liquid dispensing system 10 for dispensing liquids, such as thermoplastic materials and hot melt adhesives, generally includes a gun body 12 and a dispenser module 14 mounted to the gun body 12. The gun body 12 is provided with a mounting bracket 16 mountable to a suitable support structure (not shown), a hose port 18 for connection of a fluid line to supply liquid, and a cord set 20 that provides electrical connections. Dispenser module 14 may be any suitable flow control device adapter receive and dispense liquid. Typically, dispenser module 14 is configured with a valve assembly that is actuated between an open position for dispensing liquid and a closed position in which the flow of liquid is discontinued. The invention contemplates that the dispenser module 14 may be any liquid distribution manifold or device that may or may not include valve assemblies and that has liquid passageways for providing liquid to one or more nozzles.

With reference to FIGS. 1, 2A, 2B and 3, dispenser module 14 is provided with a nozzle 22 that includes a nozzle body 24 and an internally-threaded coupling member or connector nut 26. Connector nut 26 couples the nozzle body 24 to an externally-threaded adapter 28 extending from one end of dispenser module 14. Connector nut 26 has faceted portions 30 capable of being engaged by a tool, such as by the jaws of a wrench, for tightening the threaded engagement between nozzle body 24 and dispenser module 14. Nozzle 22 is interchangeable with other nozzles supporting discharge orifices of different diameters.

Provided in the nozzle body 24 is a first passageway 34 that receives liquid supplied from a supply passageway 36 in the dispensing module 14. Passageway 34 extends along a longitudinal axis 37 and intersects a longitudinal axis 38 of a second passageway 40 for defining a fluid path in the nozzle body 24. The dispensing module 14 includes a valve element 41 that is movable relative to a valve seat 43 located in passageway 36 for regulating the flow of liquid into passageway 34 and subsequently into passageway 40. Specifically, the valve element 41 makes a highly effective positive sealing contact along a continuous line of contact with the valve seat 43 for interrupting the flow of liquid from passageway 36 to passageway 34.

Figure 2A:
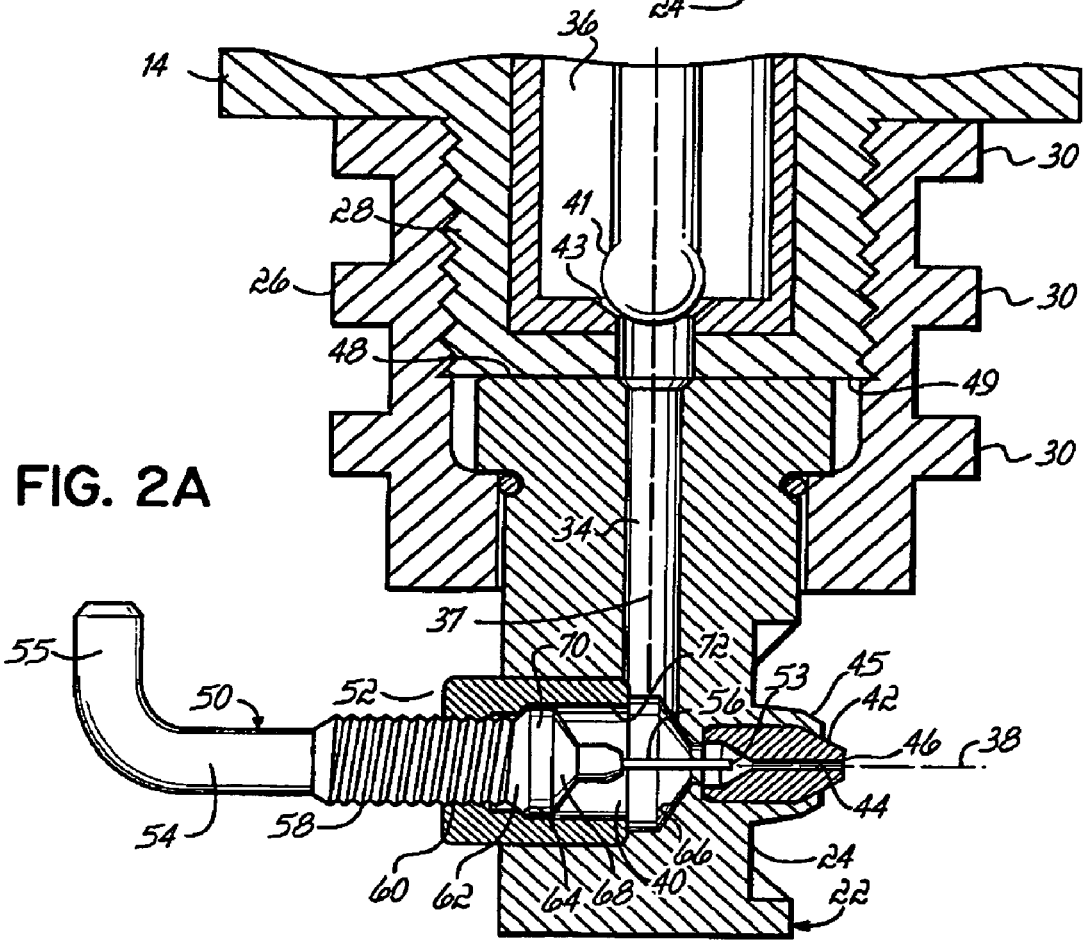
FIG. 2A is a cross-sectional view of the nozzle of FIG. 1.
Figure 2B:
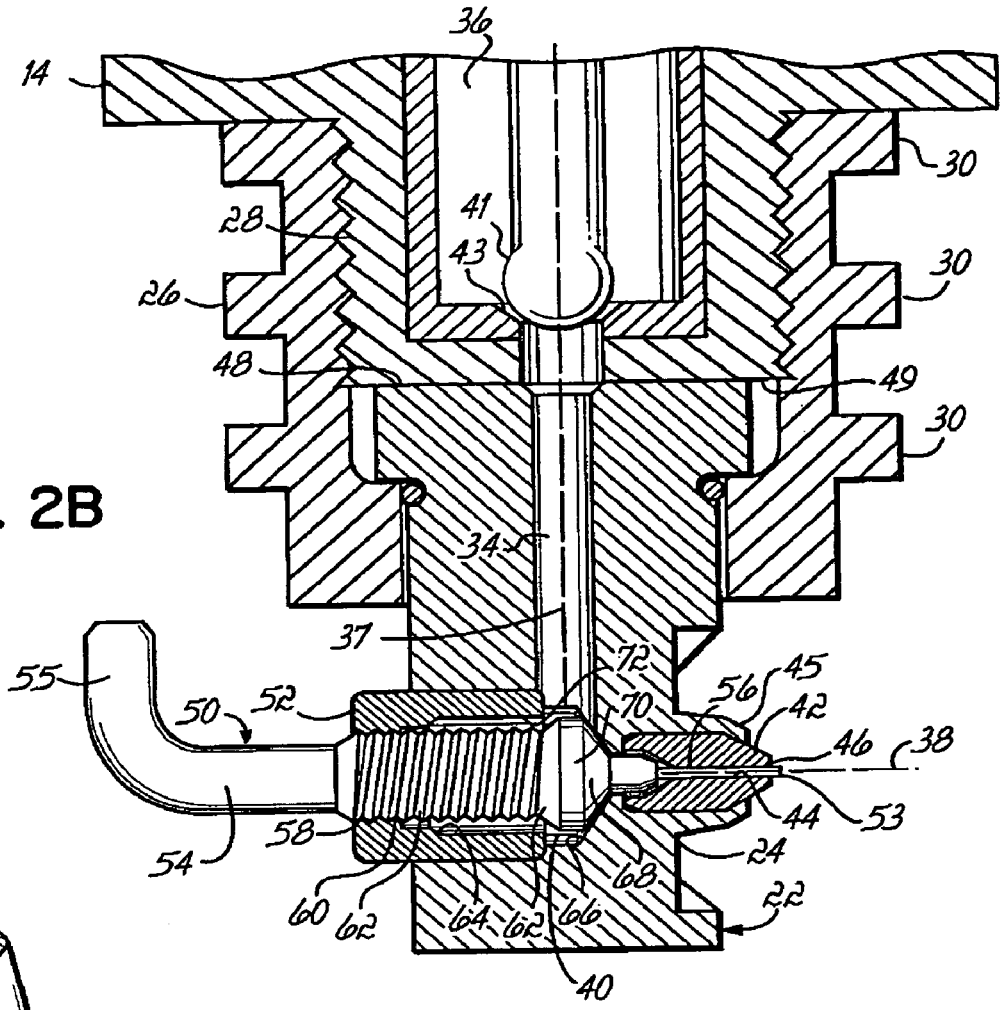
FIG. 2B is a cross-sectional view similar to FIG. 2A in which the cleaning probe is extended into the discharge passageway of the nozzle.

Positioned within passageway 40 is a nozzle insert 42 having a discharge passageway 44 terminated by a discharge orifice 46. Insert 42 is retained in place in a suitable manner, such as by crimping a surrounding area of nozzle body portion 45 as shown in FIGS. 2A and 2B. Discharge passageway 44 has the smallest diameter of any of the passageways 34, 40, 44 in nozzle 22, so that discharge passageway 44 is a likely location in the fluid path for trapping of foreign debris present in the liquid. The nozzle insert 42 is positioned such that discharge passageway 44 is substantially aligned with the longitudinal axis 38. Liquid flowing through the fluid path consisting of the interconnected passageways 34, 40, 44 is discharged from the nozzle 22 through discharge orifice 46. A planar sealing surface 48 of nozzle body 24 engages a confronting planar sealing surface 49 of adapter 28 to provide a substantially fluid-tight, face-to-face mounting of nozzle 22 to liquid dispenser 14. The nozzle body 24 may optionally be rotatable relative to the dispenser module 14 without rotating or otherwise loosening connector nut 26.

With continued reference to FIGS. 1, 2A, 2B and 3, nozzle 22 further includes a cleaning fixture 50 having a cleaning pin or probe 56 movable between retracted and extended positions for clearing foreign debris from the discharge passageway 44 in nozzle insert 42. A major axis or length of the cleaning probe 56 is aligned substantially parallel with longitudinal axis 38 of discharge passageway 44 so that a leading tip 53 of the cleaning probe 56 may enter discharge passageway 44 when moved from the retracted position to the extended position. Cleaning probe 56 occupies a small volume of supply passageway 34 when in the retracted position, which minimizes any obstruction to the flow of thermoplastic material to the discharge passageway 44.

The cleaning probe 56 is characterized by a diameter measured radially relative to its length. Typically, the diameter of cleaning probe 56 is uniform along its length, although the invention is not so limited. The diameter of the cleaning probe 56 is slightly less than a diameter of the discharge passageway 44, measured radially relative to the longitudinal axis 38 to the cylindrical, inwardly-facing surface surrounding passageway 44. The dimensional difference provides a clearance sufficient for the leading tip 53 of cleaning probe 56 to enter and extend through the discharge passageway 44. The cleaning probe 56 may be, for example, formed from a short length of wire or rod. The leading tip 53 may be blunt, as shown in FIGS. 1–3 or may have a different configuration, such as tapering to a point.

An external threaded portion 58 of cleaning fixture 50 is engaged with an internal threaded portion 60 of a bushing 52 sealingly engaged with passageway 40. Bushing 52 is fixed within body 24 in a suitable manner, such as by brazing. The mated threaded portions 58, 60 cooperate for guiding the cleaning probe 56 axially along longitudinal axis 38 toward the discharge passageway 44. A rotating driving element 54 is used to apply a torque for turning threaded portion 58 relative to stationary threaded portion 60 in one rotational direction to advance the cleaning probe 56 from the retracted position to the extended position. To withdraw the cleaning probe 56 from the extended position to the retracted position, a force is applied to driving element 54 that turns threaded portion 58 in an opposite rotational direction relative to the threaded portion 60. A handle 55 provides an angled arm for applying a rotational force to the cleaning fixture 50. Alternatively, handle 55 may be a wheel or a knob configured to facilitate manual rotation. In a broader sense, driving element 54 is a reciprocating element since it achieves the necessary back and forth motion. Such reciprocating movement could be achieved in other manners-as well, including manners that do not require rotation. Also, it will be appreciated that element 54 may be integral or separate from the remainder of fixture 50.

Figure 3:
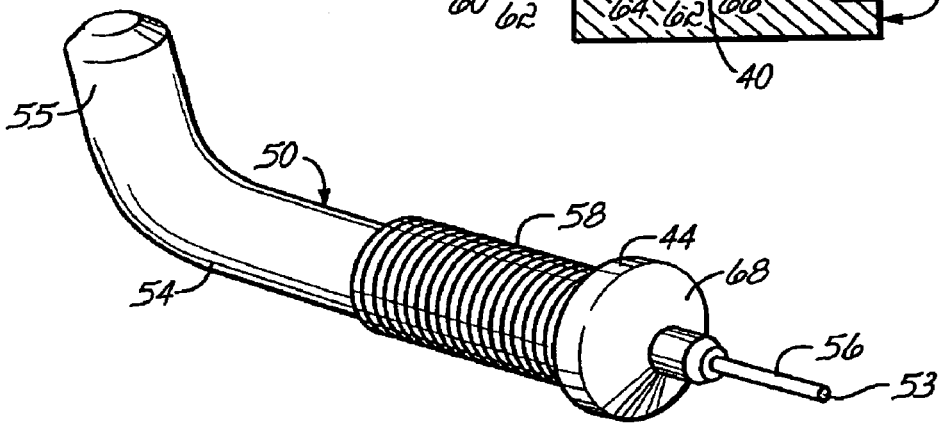
FIG. 3 is a front elevational view of the cleaning fixture.

With reference to FIGS. 2A, 2B and 3, the cleaning fixture 50 further includes a trailing shoulder 62 adapted to contact a first seating surface 64 of bushing 52 when the cleaning probe 56 is retracted, as shown in FIG. 2A, so as to provide a fluid seal and a positive stop in the retracted position. A leading shoulder 68 of cleaning fixture 50 contacts a second seating surface 66 provided in discharge passageway 44 so as to provide a positive stop in the extended position, as shown in FIG. 2B. The seating surfaces 64, 66 effectively limit the axial movement of the cleaning probe 56 along the longitudinal axis 38 and prevent fluid loss from passageway 40 in the retracted position. The shoulders 62, 68 and the seating surfaces 64, 66 are illustrated as being frustoconical in shape with complementary inclination angles, although the invention is not so limited. A cylindrical portion 70 positioned between shoulders 62, 68 has a diameter similar to the diameter of an unthreaded portion 72 of the bushing 52. Sliding contact between portions 70 and 72 assists in guiding the cleaning probe 56 toward the discharge passageway 44.

Although passageways 34 and 40 are depicted as intersecting perpendicularly, the invention is not so limited. The relative inclination of passageways 34 and 40 is constrained only by the ability to access the driving element 54 of cleaning fixture 50 from the exterior of the nozzle housing 24.

In use and with reference to FIGS. 1, 2A, 2B and 3, liquid is dispensed from discharge orifice 42 and the cleaning fixture 50 is parked in the retracted position with cleaning probe 56 located within passageway 44. If the flow of liquid from the discharge orifice 46 of nozzle 22 is perceived to be reduced or at regular maintenance intervals, the cleaning probe 52 is advanced from the retracted position to the extended position so that the cleaning probe 52 enters discharge passageway 44 and travels toward the discharge orifice 42. Movement of cleaning probe 52 in this direction causes the leading tip 53 to displace or move any foreign debris, such as char, present in the discharge passageway 44 toward the discharge orifice 42. The axial dimension or length of cleaning probe 52 is selected so that the leading tip 53 projects out of the discharge orifice 42, when in the extended position, by a distance effective for ejecting foreign debris from discharge passageway 44. After the discharge passageway 44 is cleared, the cleaning probe 52 is returned to the retracted position in passageway 40 and the dispensing of liquid from discharge orifice 42 may be resumed.

Figure 4:
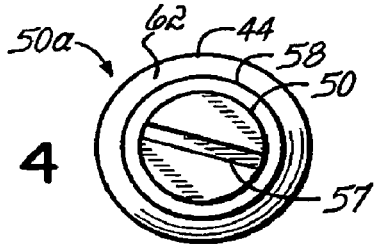
FIG. 4 is an end view of an alternative embodiment of the cleaning fixture.

With reference to FIG. 4 in which like reference numerals refer to like features in FIGS. 1, 2A, 2B and 3, the driving element 54 of a cleaning fixture 50*a* may carry a drive recess 57, such as a cross slot or a hex head. The drive recess 57 is capable of being engaged by a correspondingly shaped end of a driving tool or implement (not shown), such as a slotted-type screwdriver, a wrench or a drive socket, for rotating the driving element 54 to move the cleaning probe 56 between the retracted and extended positions.

While the present invention has been illustrated by a description of various preferred embodiments and while these embodiments have been described in considerable detail in order to describe the best mode of practicing the invention, it is not the intention of applicant to restrict or in any way limit the scope of the appended claims to such detail. Additional advantages and modifications within the spirit and scope of the invention will readily appear to those skilled in the art.

The invention itself should only be defined by the appended claims, wherein I claim:

1. A method of operating a thermoplastic material dispenser, the material dispenser including a supply passageway, a valve seat in the supply passageway, and a valve element movable relative to the valve seat for regulating a flow of thermoplastic material through the supply passageway, comprising:

moving the valve element relative to the valve seat for regulating the flow of thermoplastic material through the supply passageway;

coupling a first passageway of a nozzle in fluid communication with the supply passageway; and rotating a cleaning fixture threadingly engaged with a second passageway inclined relative to the first passageway to cause movement of an attached cleaning probe in a first direction to an extended position extending through a discharge passageway coupled with the second passageway.

2. The method of claim 1 wherein rotating the cleaning fixture further comprises:

contacting a leading shoulder of the cleaning fixture with a seating surface when said cleaning probe is in the extended position.

3. The method of claim 1 wherein rotating the cleaning probe further comprises:

guiding the cleaning probe toward the discharge passageway.

4. The method of claim 1 wherein rotating the cleaning probe further comprises:

moving foreign debris present in the discharge passageway out of a discharge orifice.

5. The method of claim 1 further comprising:

rotating the cleaning to cause movement of the cleaning probe in a second direction opposite the first direction to a retracted position withdrawn from the discharge passageway.

6. The method of claim 5 wherein rotating the cleaning fixture further comprises:

contacting a trailing shoulder of the cleaning fixture with a seating surface when said cleaning probe is in the retracted position.

7. A thermoplastic material dispenser, comprising:

a dispenser module having a supply passageway, a valve seat in said supply passageway, and a valve element movable within said supply passageway relative to said valve seat for regulating a flow of a thermoplastic material into said supply passageway;

a nozzle body having a first passageway coupled in fluid communication with said supply passageway of the dispenser, a discharge passageway for discharging the flow of the thermoplastic material, and a second passageway coupling said discharge passageway with said first passageway, said second passageway being inclined relative to said first passageway;

a cleaning probe coupled with said nozzle body, said cleaning probe moveable between a retracted position in which thermoplastic material flows through said second passageway to said discharge passageway and an extended position in which the cleaning probe extends into said discharge passageway; and a driving element having an external threaded portion engaged with said internal threaded portion of said nozzle bode, wherein rotation of said driving element causes relative movement of said external threaded portion relative to said internal threaded portion for moving said cleaning probe relative to said discharge passageway between the extended position and the retracted position.

8. The thermoplastic material dispenser of claim 7 wherein said cleaning probe includes a leading tip that projects out of said discharge orifice in the extended position.

9. The thermoplastic material dispenser of claim 7, further comprising a cleaning fixture coupled with said cleaning probe, wherein said second passageway includes a seating surface and said cleaning fixture includes a leading shoulder positioned for contacting said seating surface when said cleaning probe is in the extended position.

10. The thermoplastic material dispenser of claim 9 wherein said leading shoulder has a frustoconical shape tapering toward said seating surface.

11. The thermoplastic material dispenser of claim 7, further comprising:

a cleaning fixture coupled with said cleaning probe, wherein said second passageway includes a seating surface and said cleaning fixture includes a trailing shoulder positioned for contacting said seating surface when said cleaning probe is in the retracted position.

12. The thermoplastic material dispenser of claim 11 wherein said trailing shoulder has a frustoconical shape tapering toward said seating surface.

13. The thermoplastic material dispenser of claim 7 further comprising:

a cleaning fixture coupling said cleaning probe with said driving element, said cleaning fixture including a trailing shoulder and a leading shoulder spaced apart from the leading shoulder, and said second passageway includes a first seating surface positioned for contacting said trailing shoulder when said cleaning probe is in the retracted position and a second seating surface positioned for contacting said leading shoulder when said cleaning probe is in the extended position.

14. The thermoplastic material dispenser of claim 13 wherein said first shoulder has a frustoconical shape tapering toward said first seating surface and said second shoulder has a frustoconical shape tapering toward said second seating surface.

15. The thermoplastic material dispenser of claim 7 wherein said cleaning fixture has a threaded engagement with said second passageway.

16. The thermoplastic material dispenser of claim 7 wherein said cleaning fixture further comprises a reciprocating driving element operative for moving said cleaning probe between the retracted position and the extended position.

17. The thermoplastic material dispenser of claim 16 wherein said driving element further comprises a manually operable handle for applying a force to move said cleaning probe between the retracted position and the extended position.

18. The thermoplastic material dispenser of claim 16 wherein said driving element further comprises a drive recess capable of receiving a correspondingly-shaped end of a tool for applying a force to move said cleaning probe between the retracted position and the extended position.

19. The thermoplastic material dispenser of claim 7 wherein said second passageway is substantially orthogonal to said first passageway.

20. The thermoplastic material dispenser of claim 19 wherein said first passageway is substantially coaxial with the supply passageway.

21. The thermoplastic material dispenser of claim 7 wherein said nozzle body further comprises a bushing engaged with said second passageway, said bushing carrying said internal threaded portion.

22. The thermoplastic material dispenser of claim 7 wherein the engagement between said external threaded portion is effective to prevent movement of the cleaning probe in response to the flow of the thermoplastic material through said second passageway.

* * * * *

UNITED STATES PATENT AND TRADEMARK OFFICE

CERTIFICATE OF CORRECTION

PATENT NO. : 6,883,735 B2
DATED : April 26, 2005
INVENTOR(S) : Charles P. Ganzer It is certified that error appears in the above-identified patent and that said Letters Patent is hereby corrected as shown below:

Column 2,
Line 61, change "adapter" to -- adapted to --.

Column 4,
Line 28, delete "-" after the word "manner".

Column 5,
Line 63, after the word "cleaning" add -- fixture --.

Column 6,
Line 20, change the word "moveable" to -- movable --.

Signed and Sealed this

Twenty-sixth Day of July, 2005

JON W. DUDAS
*Director of the United States Patent and Trademark Office*